US005571052A

United States Patent [19]

Bolanos

[11] Patent Number: 5,571,052

[45] Date of Patent: Nov. 5, 1996

[54] GOLF CLUB CONSTRUCTION

[76] Inventor: Henry Bolanos, 9 Tonetta Cir., East Norwalk, Conn. 06855

[21] Appl. No.: 465,547

[22] Filed: Jun. 5, 1995

Related U.S. Application Data

[63] Continuation-in-part of Ser. No. 316,627, Sep. 20, 1994.

[51] Int. Cl.[6] ..... A63B 53/02

[52] U.S. Cl. ..... 475/313; 473/340; 473/349

[58] Field of Search ..... 273/80.1, 80 R, 273/80 A, 80.2, 80 C, 167 F, 167 G; 473/313, 340, 349

[56] References Cited

U.S. PATENT DOCUMENTS

| | | |
|---|---|---|
| D. 97,418 | 11/1935 | Smith . |
| 581,331 | 4/1897 | Brester . |
| 1,064,916 | 6/1913 | Kelly et al. . |
| D. 1,378,863 | 5/1944 | Jakosky . |
| 3,170,691 | 2/1965 | Pritchard . |
| 3,368,812 | 2/1968 | Baldwin . |
| 3,392,977 | 7/1968 | DeLacey . |
| 3,416,798 | 12/1968 | Pennington . |
| 3,759,527 | 9/1973 | Witherspoon . |
| 3,817,534 | 6/1974 | Carlino . |
| 3,819,181 | 6/1974 | Mills . |
| 4,725,062 | 2/1988 | Kinney, III . |
| 5,078,398 | 1/1992 | Reed et al. . |
| 5,116,047 | 5/1992 | Phelan et al. . |
| 5,199,707 | 4/1993 | Knox . |
| 5,224,702 | 7/1993 | Turner . |
| 5,312,105 | 5/1994 | Cleveland . |
| 5,316,298 | 5/1994 | Hutin et al. . |

FOREIGN PATENT DOCUMENTS

| | | |
|---|---|---|
| 535848 | 4/1993 | European Pat. Off. . |
| 900424 | 1/1990 | WIPO . |

OTHER PUBLICATIONS

Wilson, Staff Milled Putters, Feb. 1995.
Plop, Precision Milled Putters, Mar. 1995.

*Primary Examiner*—Mark S. Graham
*Attorney, Agent, or Firm*—Dilworth & Barrese

[57] ABSTRACT

A golf putter is disclosed which includes an elongate shaft defining a shaft axis, and opposed proximal and distal end portions, and a putter head associated with the distal end portion of the shaft. The putter head defines a body having a center of mass located therein, an external striking face spaced from the center of mass, and a center of effort located at the striking face. The center of effort is in axial alignment with the center of mass to define an axis of effort extending through the body. The distal end portion of the shaft extends substantially through the body such that the shaft axis intersects the axis of effort at a location forward of said center of mass and proximate the striking face, such that the putter head is equally balanced about the center of effort.

6 Claims, 6 Drawing Sheets

Fig. 11
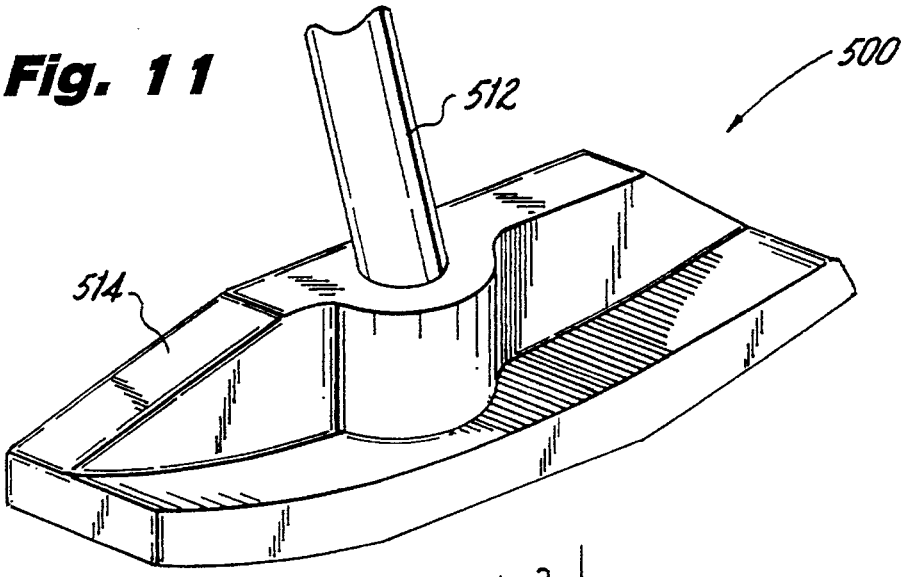
Fig. 13
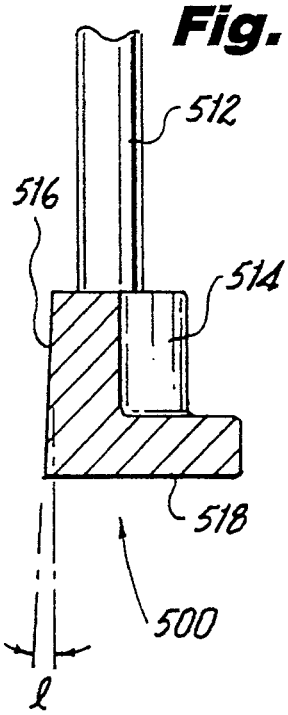
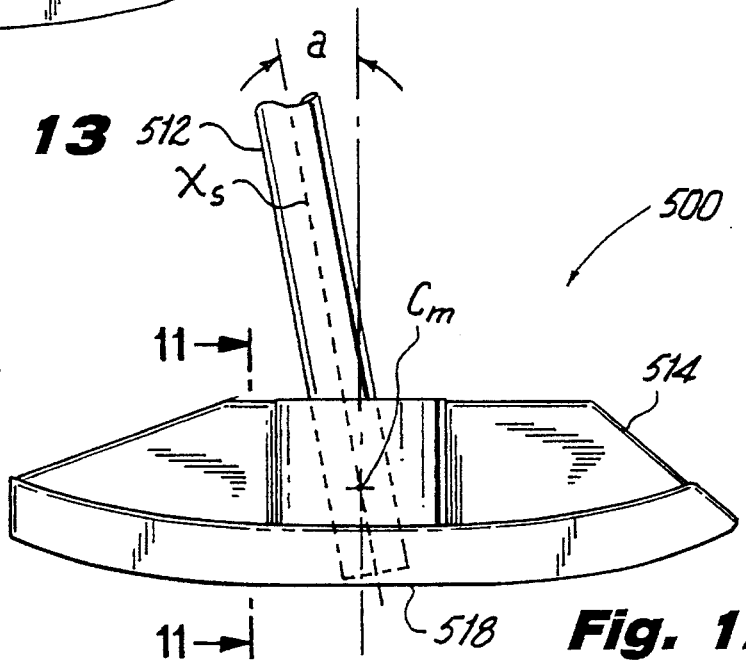
Fig. 12
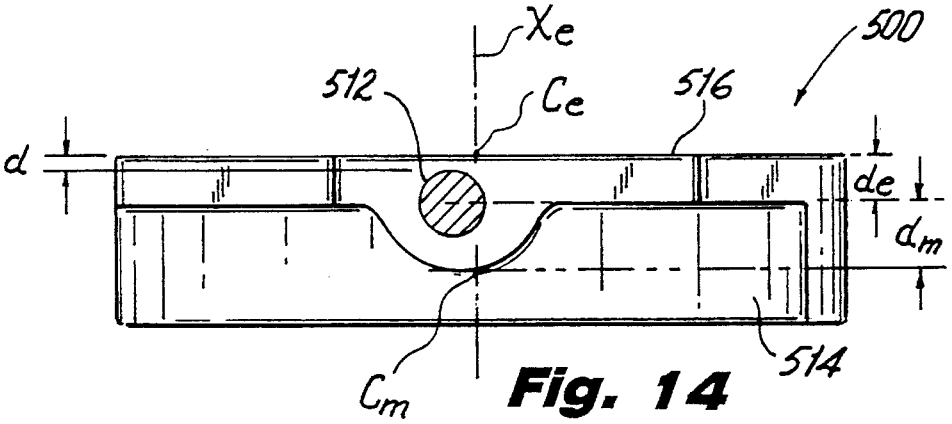
Fig. 14

GOLF CLUB CONSTRUCTION

CROSS-REFERENCE TO RELATED APPLICATION

This application is a continuation-in-part of copending U.S. Appln. Ser. No. 08/316,627 filed Sep. 30, 1994.

BACKGROUND OF THE INVENTION

1. Field of the Invention

This invention relates to golf clubs, and more particularly, to an improved golf putter configured to limit angular deviation of the striking face with respect to the intended arc of the golf swing.

2. Description of the Related Art

Wood type golf clubs or drivers traditionally have a generally ovoid head mounted to an elongated shaft. A planar surface is formed on the front of the club head which defines a striking face for hitting a golf ball. A central region of the striking face located directly in front of the center of mass of the club head defines a "sweet spot" or a center of effort. A line drawn through the center of effort and the center of mass will define an axis of effort through which optimum striking power may be directed during a golf swing.

Typically, the golf club shaft is offset from the axis of effort so that a moment-arm is created between the shaft axis and the center of effort. Ideally, the moment-arm should be perpendicular to the arc of the golf swing. However, irregularities in the golfers motion, as well as flexure of the shaft due to centrifugal forces generated during the swing, will tend to orient the moment-arm at an angle to the arc of the swing. As a result, the striking lace of the club head will deviate and impact the golf ball at an angle, imparting an undesirable spin on the ball, and causing it to hook or slice away from the golfer.

The same concept applies to golf putters. In fact, several prior art putters have been constructed to compensate for irregularities in a golfer's swing. An example of one such putter is disclosed in U.S. Pat. No. 5,078,398 to Reed et al. which attempts to eliminate the undesirable effects of irregularities in the golfers swing by aligning the club shaft with the center of gravity of the club head. This is achieved by angularly offsetting the hosel from the heel of the golf club such that the shaft axis intersects the center of gravity of the club head. However, the club shaft does not extend through the club head nor does the shaft axis intersect the axis of effort of the club head forward of the center of gravity. Thus, the club shaft may twist or rotate during the golfers swing, causing the ball to deviate from its intended path.

It would be desirable to provide an improved golf putter which is constructed in such a manner so as to substantially limit the degree to which the plane of the club face deviates from its intended path, namely, a path perpendicular to the arc of the golfers swing.

SUMMARY OF THE INVENTION

The subject invention is directed to a unique golf club, and more particularly, to a driver and a putter, both of which include an elongate shaft defining a shaft axis, and a club head associated with a distal end portion of the elongate shaft. The club head defines a body having a center of mass located therein, an external striking face spaced from the center of mass, and a center of effort located at the striking face. The center of effort is in axial alignment with the center of mass and together these points define an axis of effort extending through the body of the club head. The distal end portion of the elongate shaft extends substantially through the body such that the shaft axis intersects the axis of effort within the body forward of the center of mass and proximate the striking face.

The construction of the subject golf club inhibits shaft flexure by substantially eliminating the amount of torque generated at the club head during a golf swing, and ensures that the striking face of the club head is maintained perpendicular to the arc of the golf swing at the moment the golf ball is impacted by the club head. As a result, an undesirable spin will not be imparted to the golf ball.

In another embodiment of the subject invention, the club head includes a first axial bore extending through the body and defining a first axis which intersects the axis of effort, and a second axial bore extending through the body and defining a second axis which is spaced from the axis of effort and parallel to the first axis. Means are associated with the distal end portion of the elongate shaft for releasably engaging the elongate shaft within either the first axial bore or the second axial bore. Preferably, the means for engaging the shaft includes a fastener sleeve provided on the distal end portion of the shaft which is dimensioned and configured for releasable engagement within either of the axial bores. A plug is also provided for engagement within one of the first and second axial bores when the distal end portion of the shaft is releasably engaged within the other of the first and second axial bores.

These and other features of the subject invention will become more readily apparent from the following derailed description of the invention taken in conjunction with the drawings.

BRIEF DESCRIPTION OF THE DRAWINGS

So that one skilled in the art to which the subject invention appertains will better understand how to make and use the invention, preferred embodiments thereof will be described hereinbelow with reference to the drawings wherein:

FIG. 11 is a perspective view of a golf putter constructed in accordance with a preferred embodiment of the subject invention;

FIG. 12 is a front elevational view of the golf putter illustrated in FIG. 11;

FIG. 13 is a cross-sectional view taken along line 13—13 of FIG. 12; and FIG. 14 is a top plan view of the golf putter of FIG. 11;

DETAILED DESCRIPTION OF THE PREFERRED EMBODIMENTS

Figure 1:
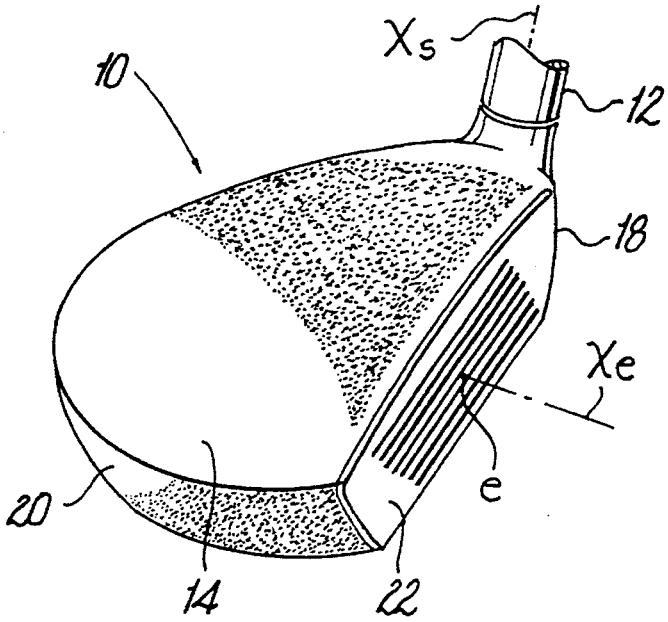
Fig. 1 (Prior Art)
FIG. 1 is a perspective view of a prior art golf club.
Figure 2:
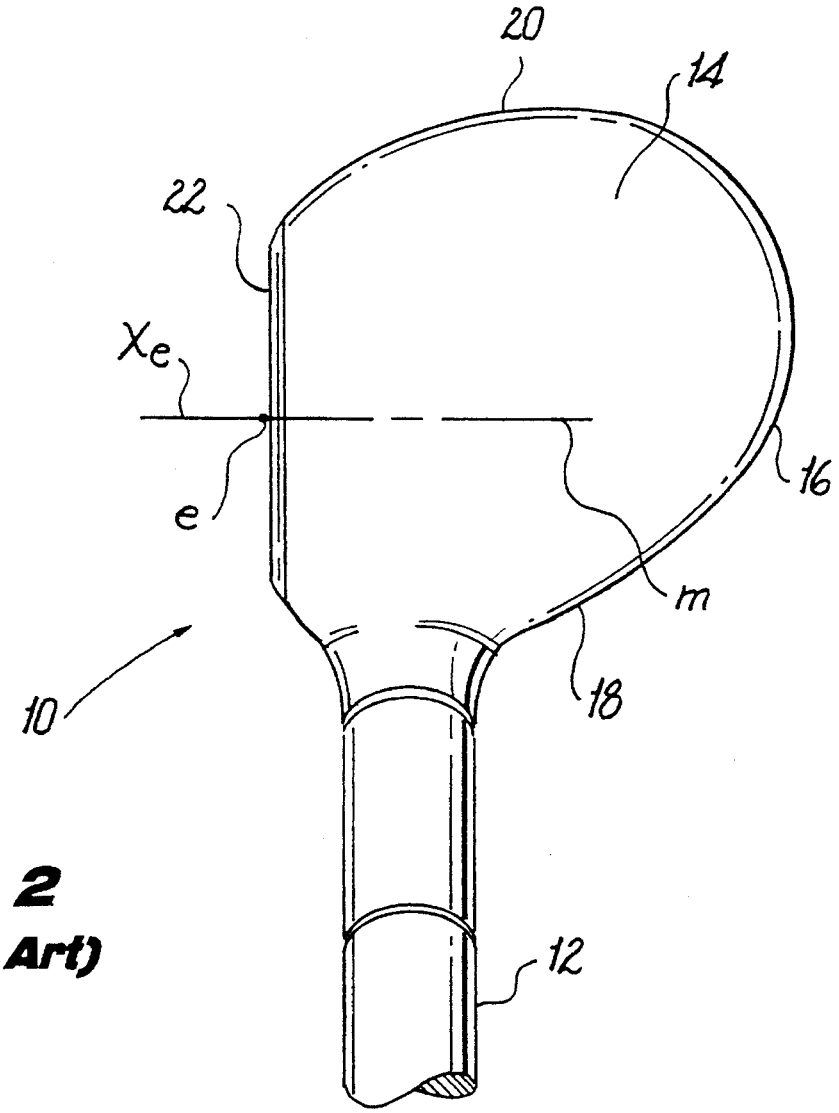
Fig. 2 (Prior Art)
FIG. 2 is a top plan view of the golf club illustrated in FIG. 1.

In the drawings and in the description which follows, the term "distal", as is traditional, will refer to the end of the golf club shaft which is furthest from the golfer. Referring now to the drawings wherein like reference numerals identify similar structural elements, there is illustrated in FIGS. 1 and 2 a prior art golf club, namely a driver, which is designated generally by reference numeral 10. Golf club 10 includes an elongated shaft 12 and a club head 14. The club head 14 defines a body 16 having a heel 18, a toe 20, and a striking face 22. Striking face 22 defines a point referred to as the "center of effort" or the "sweet spot" where optimum driving power may be imparted to a golf ball. The center of effort of striking face 22 is located ahead of the center of mass "m" of the club head, and is designated by the letter "e". A line extending through the center of effort and the center of mass defines an axis of effort "$x_c$" of the club head 14.

Figure 3:
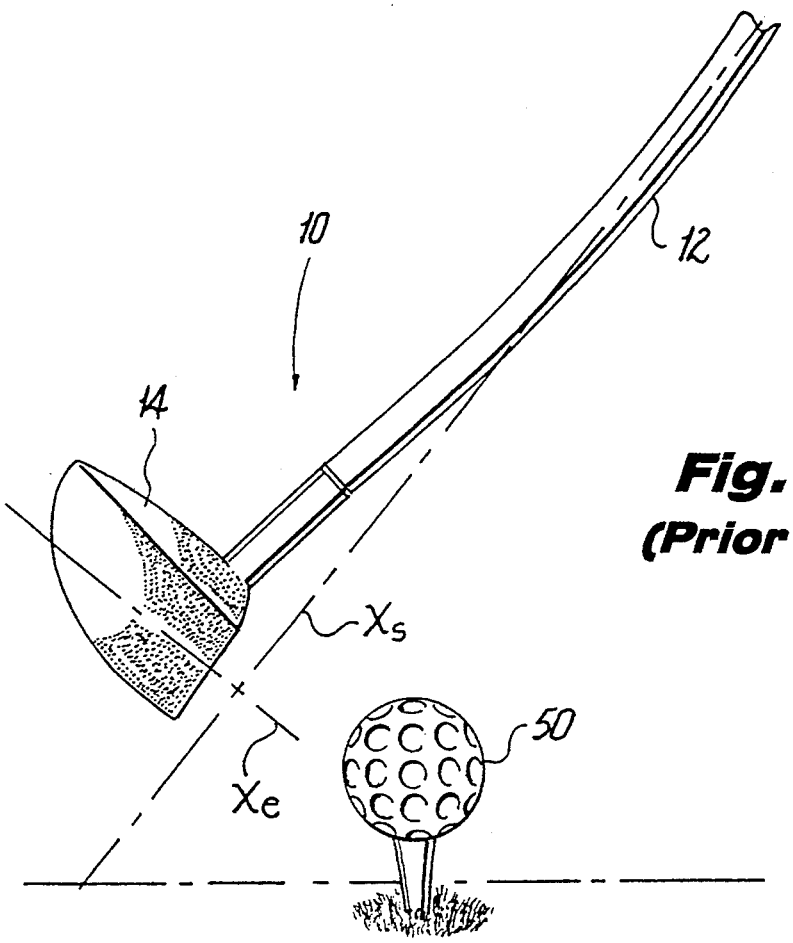
Fig. 3 (Prior Art)
FIG. 3 is a perspective view of the golf club of FIG. 1 during a golf swing.
Figure 4:
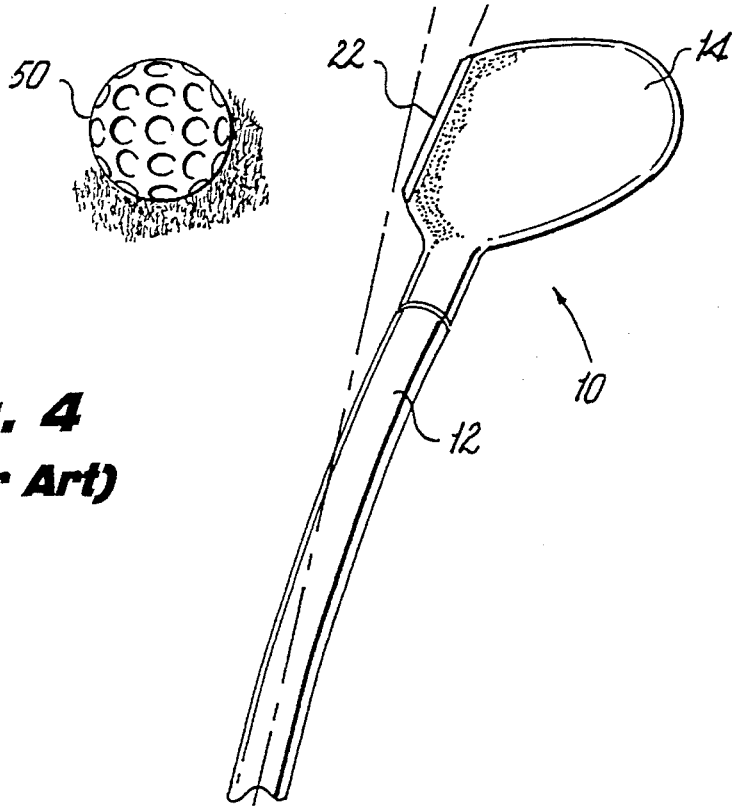
Fig. 4 (Prior Art)
FIG. 4 is a perspective view of the golf club of FIG. 1, as viewed from above, during a golf swing.

The distal end of the elongated shaft 12 of the prior art golf club 10 is mounted to club head 14 adjacent the heel 18 of body 16. Thus, the shaft axis "$x_s$" is offset from the axis of effort "$x_c$" of the club head, and a moment-arm is created between the two axes lying parallel to striking face 22. Ideally, during a golf swing, this moment-arm should remain perpendicular to the arc of the golfers swing. However, as illustrated in FIGS. 3 and 4, centrifugal forces generated during a golf swing will tend to cause the shaft of the prior art golf club 10 to flex angularly and/or twist axially. This undesirable movement will cause the striking face of the club head to deviate angularly from its intended path, namely perpendicular to the arc of the golfers swing. Thus, upon impact, an undesirable spin will be imparted to golf ball 50, causing the ball to hook or slice away from the golfer.

Figure 5:
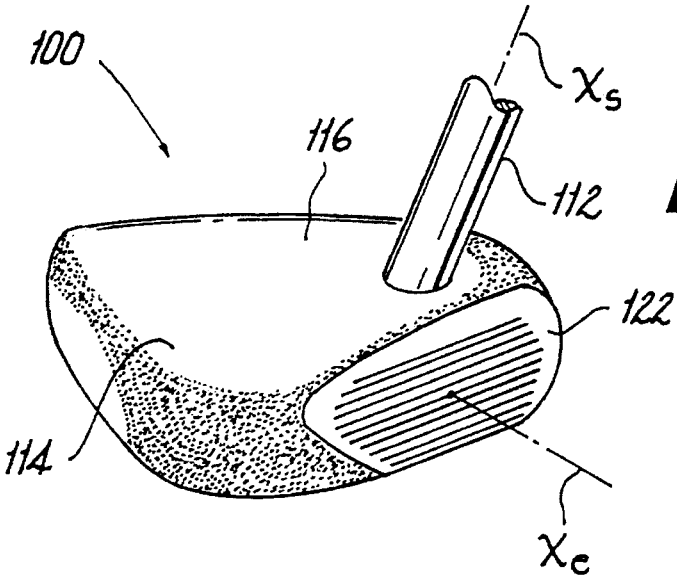
FIG. 5 is a perspective view of a golf club constructed in accordance with a preferred embodiment if the subject invention.
Figure 6:
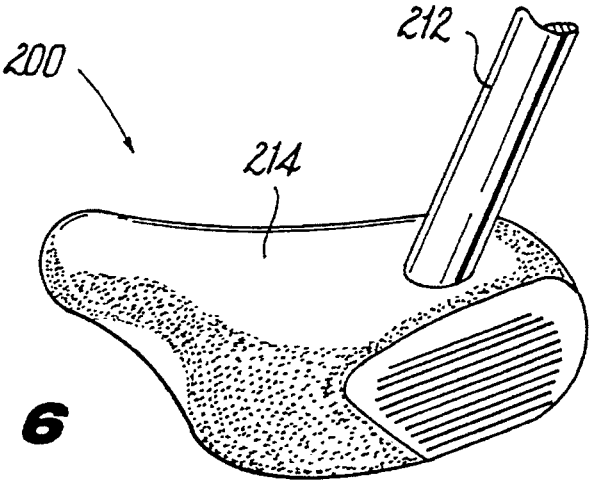
FIG. 6 is a perspective view of another golf club constructed in accordance with a preferred embodiment of the subject invention.

Referring now to FIGS. 5 and 6, there are illustrated two golf clubs 100 and 200 which are both constructed in accordance with a preferred embodiment of the subject invention. Golf club 100 includes an elongated shaft 112 and a club head 114, and golf club 200 includes a shaft 212 and a head 214. Club heads 100 and 200 are both configured in such a manner so that the center of mass of the club head is located substantially at the geometric center of the club head. This construction is intended to eliminate undesirable moment forces that may become associated with an asymmetric club head design such as that which is associated with the prior art club head illustrated in the FIG. 1. Furthermore, the symmetric configurations of club heads 114 and 214 are intended to improve the aerodynamics of the golf clubs by reducing wind resistance during a golf swing. Club heads 114 and 214 can be solid or hollow in construction, and can be fabricated from wood, steel, aluminum, titanium, ceramic, or plastic.

Figure 7:
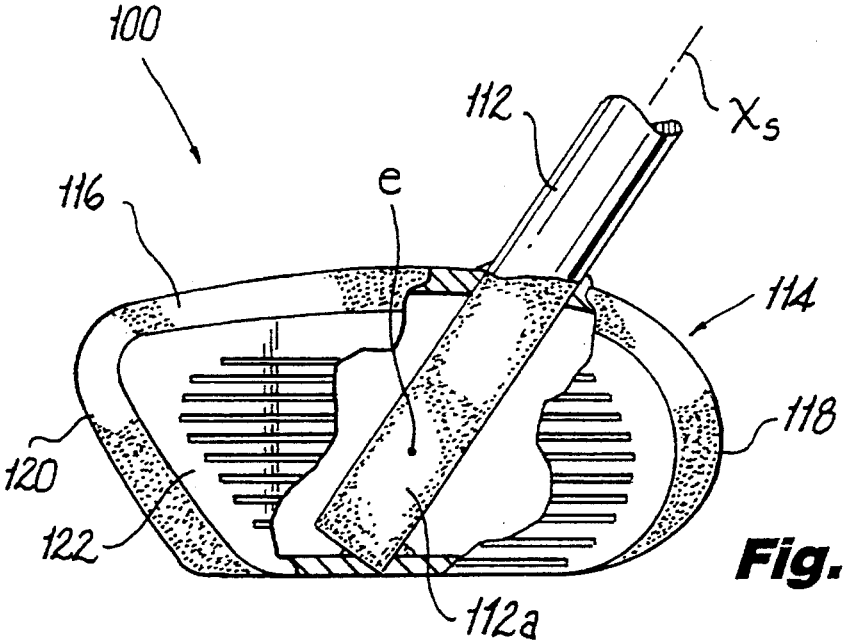
FIG. 7 is a front elevational view, in partial cross-section, of the golf club illustrated in FIG. 5.
Figure 8:
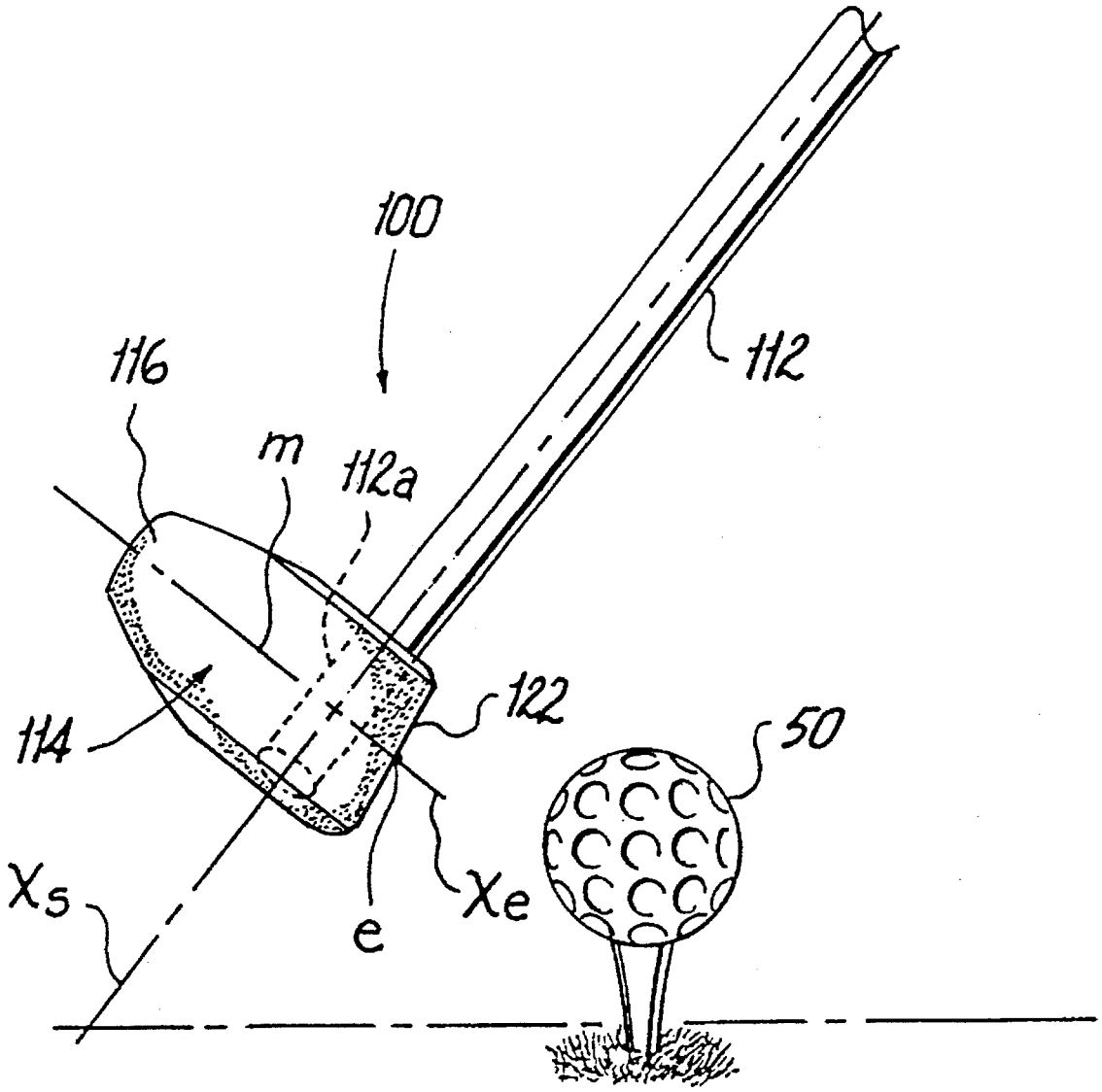
FIG. 8 is a perspective view of the golf club of FIG. 5 during a golf swing.

Referring to FIGS. 7 and 8, golf club 100 includes a body 116 having a center of mass located therein, a heel 118, a toe 120, and a striking face 122 defining a center of effort "e". As illustrated in FIG. 8, an axis of effort "$x_c$" extends through the center of effort and the center of mass of club head 114. The elongated shaft 112 of golf club 100 defines a shaft axis "$x_s$" and includes a distal portion **112*a*** which extends substantially through the club head such that the shaft axis intersects the axis of effort. This construction substantially limits shaft flexure and axial twist resulting from centrifugal forces generated during a golf swing. Accordingly, the degree to which the striking face of the club head will deviate from its intended orientation during a golf swing is significantly minimized. In addition, this construction provides more power during the golf swing, since the shaft is aligned with the center of effort or the "sweet spot" of the club head.

Figure 9:
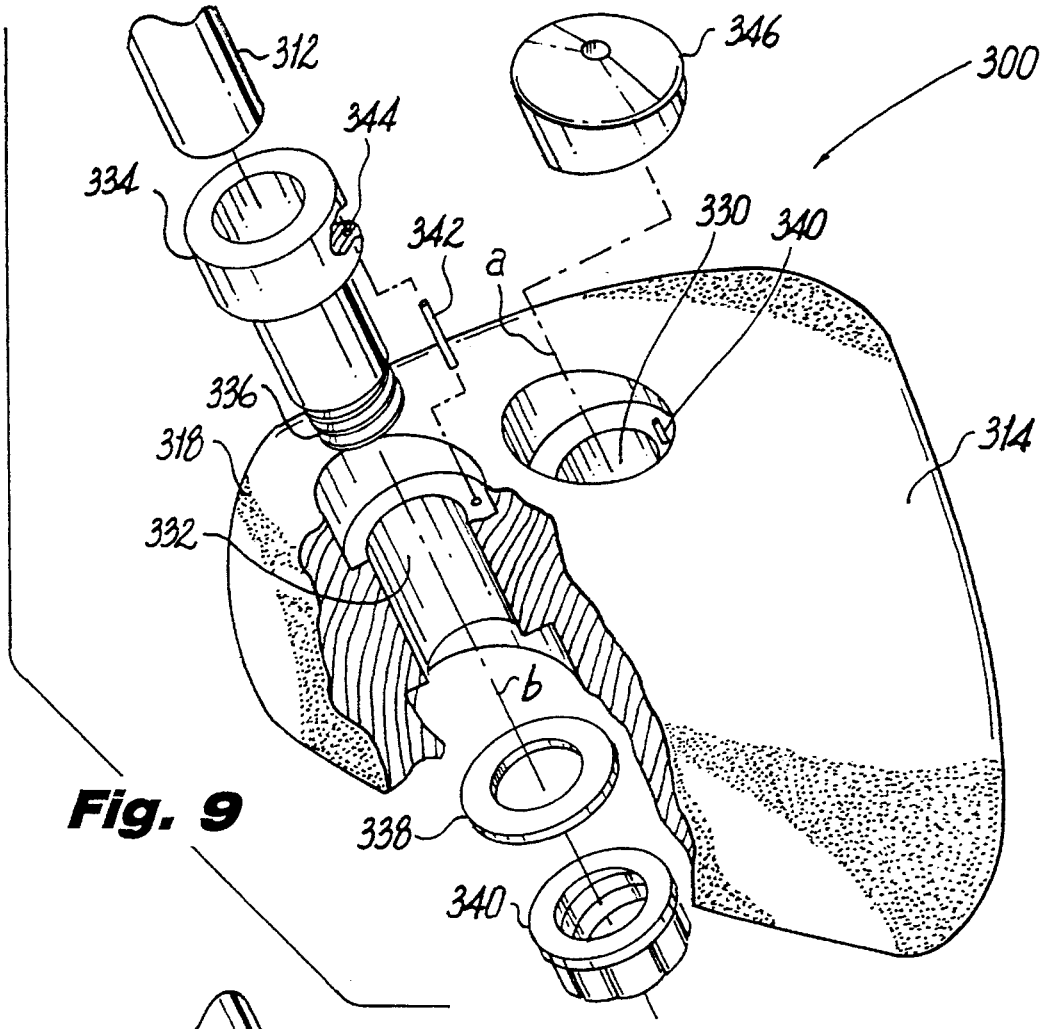
FIG. 9 is a perspective view of another golf club assembly constructed in accordance with a preferred embodiment of the subject invention.

Referring to FIG. 9, another golf club constructed in accordance with a preferred embodiment of the subject invention is illustrated and is designated generally by reference numeral 300. Golf club 300 includes an elongated shaft 312 and a detachable club head 314. Club head 314 includes a first axial bore 330 which defines a first axis "a", and a second axial bore 332 which defines a second axis "b". The first axis intersects the axis of effort of club head 314 and provides the advantages discussed hereinabove with respect to golf club 100. The second axis is parallel to the first axis and extends through the heel 318 of club head 314, and enables the golfer to mount shaft 312 in a conventional location. Preferably, both axes are disposed at an angle of between 50° and 60° to a horizontal plane defined by the bottom surface of the club head.

A sleeve 334 is mounted on the distal end of elongated shaft 312 and is dimensioned and configured for engagement within either of the first and second axial bores formed in club head 314. The sleeve includes a threaded portion 336 for receiving a washer 338 and a threaded fastener 340 which retains the sleeve in the club head and inhibits relative axial movement of the shaft and the club head. In addition, set pins 340 and 342 are disposed within the axial bore 330 and 332, respectively, for engaging a corresponding aperture 344 defined in sleeve 334 to inhibit relative rotational movement of the club head and the shaft. A bore plug 346 is also provided for sealing which ever one of the axial bores not engaged by sleeve 334.

Figure 10:
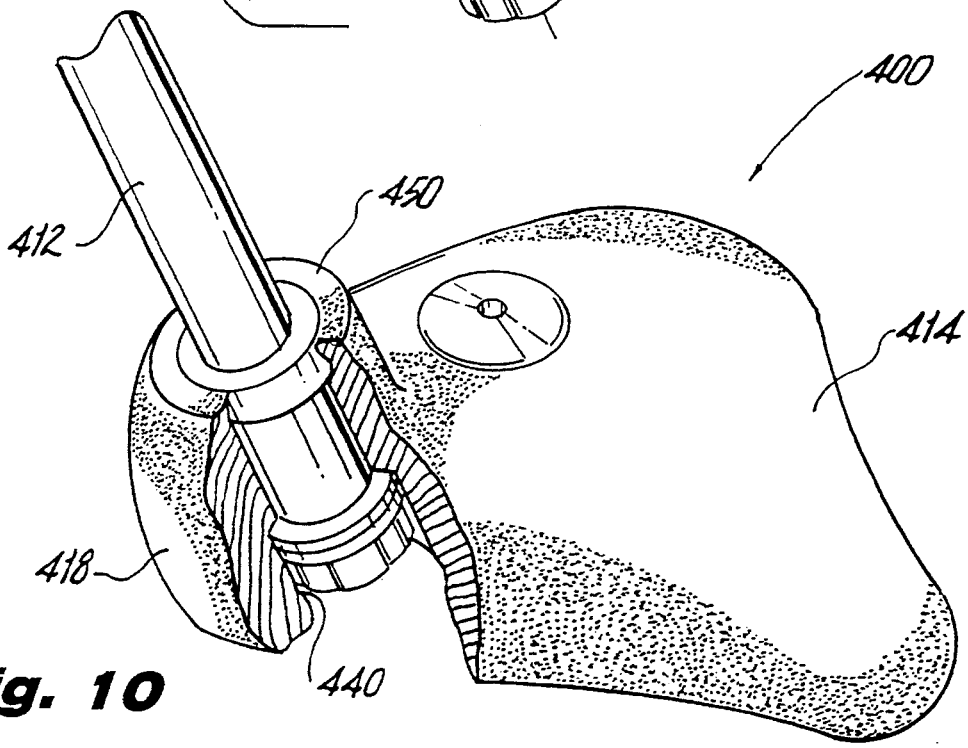
FIG. 10 is a perspective view of yet another golf club assembly constructed in accordance with a preferred embodiment of the subject invention.

Referring to FIG. 10, another golf club constructed in accordance with a preferred embodiment of the subject invention is illustrated and is designated generally by reference numeral 400. Golf club 400 is substantially similar to the golf club 300 illustrated in FIG. 9, and described hereinabove. However, the club head 412 of golf club 400 has a raised hosel 450 formed at the heel 418 of the club head and defining the axial bore 440. Hosel 450 provides the golfer with a club head that resembles that of a conventional prior art golf club.

Referring now to FIG. 11, there is illustrated a unique golf putter constructed in accordance with a preferred embodiment of the subject invention and designated generally by reference numeral 500. Putter 500 is constructed in such a manner so as to limit angular deviation of its striking face during a golfing swing.

Referring to FIG. 12, putter 500 includes an elongated club shaft 512 through which extends a shaft axis $x_s$, and a club body 514 having a center of mass $c_m$. As illustrated in FIG. 14, the center of mass $c_m$ is aligned with the center of effort $c_c$ of striking face 516 to define an axis of effort $x_c$. As best seen in FIG. 12, the shaft axis $x_s$ intersects the axis of effort $x_c$ at a location within club body 514 forward of the center of mass $c_m$ and proximate striking face 516. Specifically, the distance "d" between striking face 516 and a line drawn tangent to shaft 512 and parallel to striking face 516 is about between 0.040 inches to about 0.060 inches such that the distance $d_c$ between the center of effort and the shaft axis along the axis of effort is substantially less than the distance $d_m$, between the shaft axis and the center of mass along the axis of effort.

With continued reference to FIG. 12, club body 514, which is preferably constructed from brass, has a planar bottom surface 518 which traverses less than half of the total length of club body 514. The distal end of club shaft 512 extends through body 514 to a point which is about between 0.03 inches to 0.08 inches from bottom surface 518. The angle of orientation "a" of club shaft 512 is about between 10° to 15° with respect to a line drawn perpendicular to the bottom surface 518 of club body 514. As best seen in FIG. 13, striking face 516 has a loft angle "1" of about between 2° and 5° with respect to a line drawn perpendicular to bottom surface 518.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. A golf putter comprising:

a) an elongate shaft defining a shaft axis, and opposed proximal and distal end portions; and b) a putter head associated with said distal end portion of said elongate shaft, said putter head defining a body having a center of mass located therein, an external striking face spaced from said center of mass, and a center of effort located at said striking face, said center of effort being in axial alignment with said center of mass to define an axis of effort, said distal end portion of said elongate shaft extending substantially through said body such that said shaft axis intersects said axis of effort at a location forward of said center of mass and proximate said striking face, wherein the distance between said center of effort and said shaft axis along said axis of effort is substantially less than the distance between said shaft axis and said center of mass along said axis of effort.

2. A golf putter as recited in claim 1, wherein said putter head has a planar bottom surface and said shaft axis forms an angle of entry with said bottom surface of about between 10° and 15°.

3. A golf putter as recited in claim 2, wherein said shaft extends through said body to a point which is approximately 0.03 inches to 0.08 inches from said bottom surface.

4. A golf putter as recited in claim 2, wherein said striking face forms an angle of loft with a line perpendicular to said bottom surface of about between 2° and 4°.

5. A golf putter as recited in claim 1, wherein the distance between said striking face and a line tangent to said shaft and parallel to said striking face is about between 0.040 inches and 0.060 inches.

6. A golf putter comprising:

a) an elongate shaft defining a shaft axis, and opposed proximal and distal end portions; and b) a putter head associated with said distal end portion of said elongate shaft, said putter head defining a body having a center of mass located therein, a substantially planar bottom surface, an external striking face spaced from said center of mass, and a center of effort located at said striking face, said center of effort being in axial alignment with said center of mass to define an axis of effort, said distal end portion of said elongate shaft extending substantially through said body to a location proximate said bottom surface such that said shaft axis intersects said axis of effort at a location forward of said center of mass and proximate said striking face, wherein the distance between said center of effort and said shaft axis along said axis of effort is substantially less than the distance between said shaft axis and said center of mass along said axis of effort.

* * * * *